United States Patent [19]

Chung

[11] 4,375,447

[45] Mar. 1, 1983

[54] METHOD FOR FORMING AN AIR-LAID WEB OF DRY FIBERS

[75] Inventor: Raymond Chung, Neenah, Wis.

[73] Assignee: Kimberly-Clark Corporation, Neenah, Wis.

[21] Appl. No.: 250,545

[22] Filed: Apr. 3, 1981

Related U.S. Application Data

[63] Continuation-in-part of Ser. No. 106,141, Dec. 21, 1979, abandoned.

[51] Int. Cl.[3] ..... D04H 3/16

[52] U.S. Cl. ..... 264/518; 264/114; 264/121

[58] Field of Search ..... 264/518, 121, 114; 425/83.1

[56] References Cited

U.S. PATENT DOCUMENTS 3,949,035 4/1976 Dunning et al. ..... 264/518

4,335,066 6/1982 Dinius ..... 264/121

*Primary Examiner*—James R. Hall

*Attorney, Agent, or Firm*—Gregory E. Croft; William D. Herrick; R. Jonathan Peters

[57] ABSTRACT

Methods for pre-forming and feeding a lightly compacted batt of individualized fibers having a controlled cross-directional profile directly to a rotary fiber orienting and screening mechanism across the full width thereof so as to maintain a controlled cross-directional profile in an air-laid web of dry fibers formed in a high speed dry web forming system.

12 Claims, 11 Drawing Figures

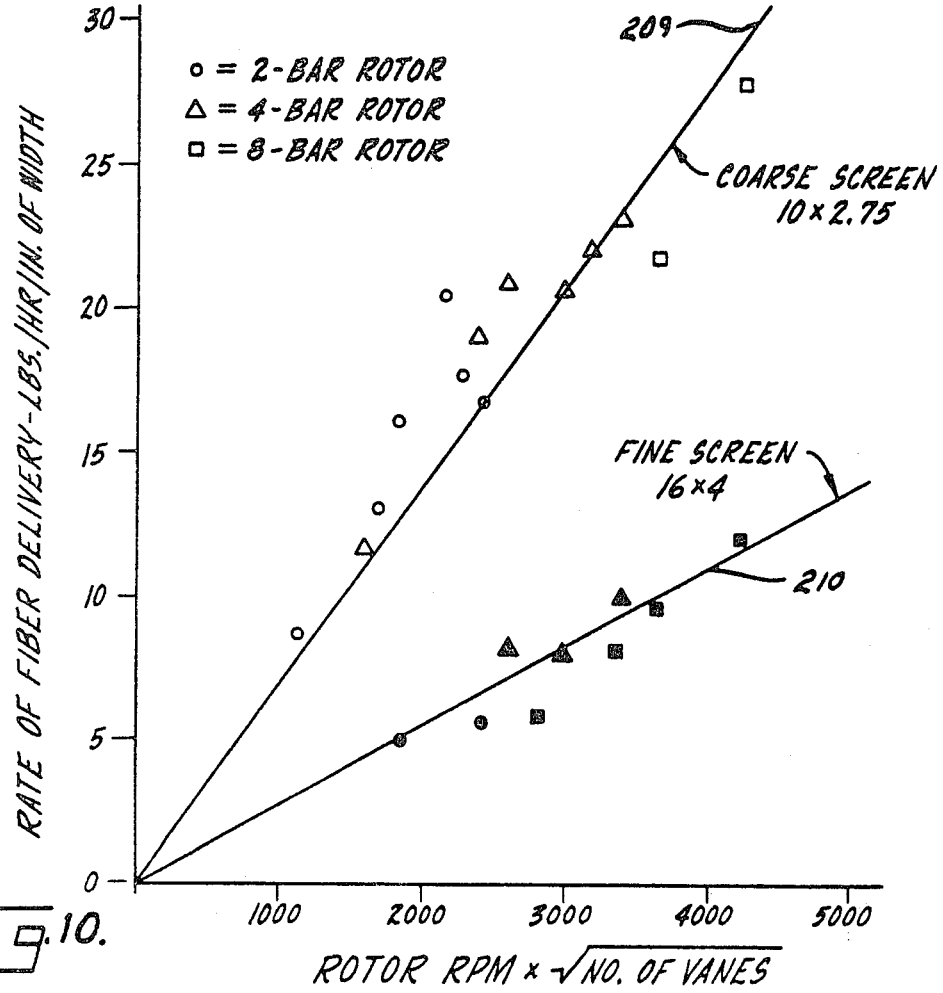
fig. 10.
fig. 11.
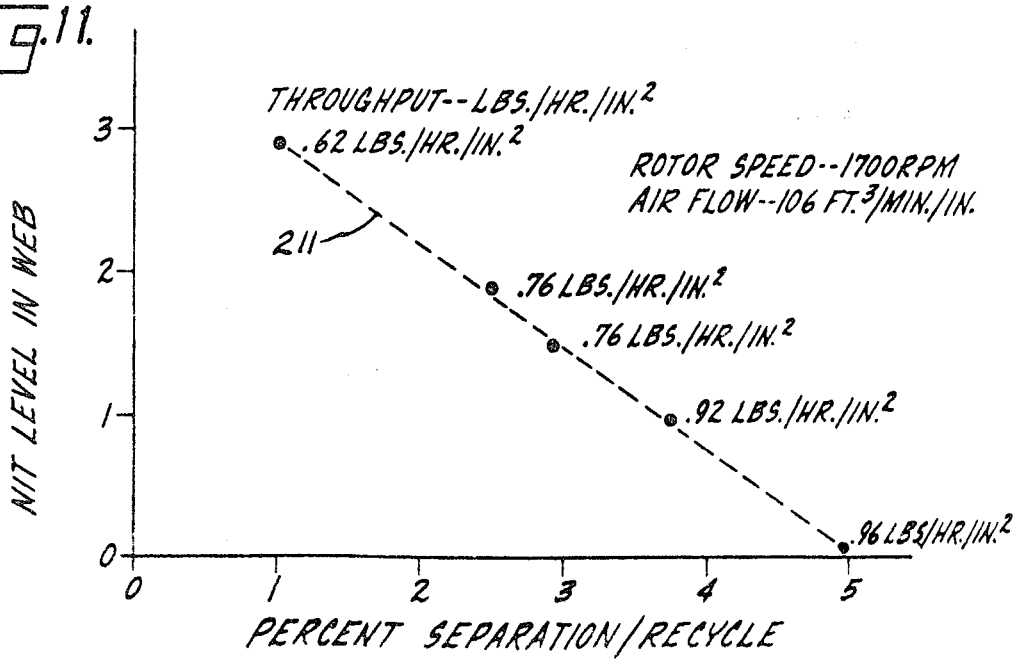

METHOD FOR FORMING AN AIR-LAID WEB OF DRY FIBERS

RELATED APPLICATIONS

This application is a continuation in part of application Ser. No. 106,141, filed Dec. 21, 1979 now abandoned.

BACKGROUND OF THE INVENTION

The present invention relates in general to a method for forming non-woven webs of dry fibers having a controlled cross-directional profile on a high-speed production basis wherein the fibrous materials input to the system are first formed into a lightly compacted feed mat having a controlled cross-directional profile, wherein the feed mat is fed directly to the forming head without being pre-opened and conveyed in an air/fiber stream. The web thus formed is characterized by a random dispersion of essentially undamaged, uncurled, individualized fibers disposed in a controlled cross-directional profile and is substantially devoid of aggregated fiber masses so as to result in a web of aesthetically pleasing appearance and increased tensile strength.

Conventionally, materials suitable for use as disposable tissue and towel products have been formed on paper-making equipment by water-laying a wood pulp fibrous sheet at speeds exceeding 5,000 feet per minute. Following formation of the sheet, the water is removed either by drying or by a combination of pressing and drying. As water is removed during formation, surface tension forces of very great magnitude develop which press the fibers into contact with one another, resulting in overall hydrogen bonding at substantially all fiber intersections. The hydrogen bonds between fibers provide sheet strength but result in very unfavorable tactile properties and low bulk characteristics.

To improve these unfavorable properties, water-laid sheets are typically creped from the dryer roll, reforming the flat sheet into a corrugated-like structure, thereby increasing its bulk and simultaneously breaking a significant portion of the fiber bonds, thus artificially improving the tactile and absorbency properties of the material. However, creping is most effective on low (less than about 15 lbs./2800 ft.$^2$) basis weight webs. When a higher basis weight is desired, it is conventional practice to employ at least two plies of creped low basis weight paper sheets for such uses.

Conventional paper-making methods possess the inefficient attribute of initial "overbonding," which then necessitates a creping step to partially "debond" the sheet, and have extreme water requirements which create an associated water pollution problem. Still futher, the essential drying procedures consume tremendous amounts of energy.

Air forming of wood pulp fibrous webs has been carried out for many years; however, the resulting webs have been used for applications where either little strength is required, such as for absorbent products—i.e., pads—or applications where a certain minimum strength is required but the tactile and absorbency properties are unimportant—i.e., various specialty papers. U.S. Pat. Nos. 2,447,161 to Coghill, 2,810,940 to Mills, and British Pat. No. 1,088,991 illustrate various air-forming techniques for such applications.

In the late 1940's and early 1950's, work by James D'A. Clark resulted in the issuance of a series of patents directed to systems employing rotor blades mounted within a cylindrical fiber "disintegrating and dispersing chamber" wherein air-suspended fibers were fed to the chamber and discharged from the chamber through a screen onto a forming wire—viz., J. D'A. Clark U.S. Pat. Nos. 2,748,429, 2,751,633 and 2,931,076. However, Clark and his associates encountered serious problems with these types of forming systems as a result of disintegration of the fibers by mechanical co-action of the rotor blades with the chamber wall and/or the screen mounted therein which caused fibers to be "rolled and formed into balls or rice which resist separation"—a phenomenon more commonly referred to today as "pilling". Additionally, J. D'A. Clark encountered problems producing a web having a uniform cross-direction profile, because the fiber input and fiber path through the rotary former was not devoid of cross flow forces.

A second type of system for forming air-laid webs of dry cellulosic fibers which has found limited commercial use has been developed by Karl Kristian Kobs Kroyer and his associates as a result of work performed in Denmark. Certain of these systems are described in: Kroyer U.S. Pat. Nos. 3,575,749 and 4,014,635; Rasmussen 3,581,706 and 3,669,778; Rasmussen et al. 3,769,115; Attwood et al. 3,976,412; Tapp 4,060,360; and, Hicklin et al. 4,074,393.

This type of sifting equipment suffers from poor productivity especially when making tissue-weight webs. For example, the rotor action concentrates most of the incoming material at the periphery of the blades where the velocity is at a maximum. Most of the sifting action is believed to take place in these peripheral zones, while other regions of the sifting screen are either covered with more slowly moving material or are bare. Thus, a large percentage of the sifting screen area is poorly utilized and the system productivity is low. Moreover, fibers and agglomerates tend to remain in the forming head for extended periods of time, especially in the lower velocity, inner regions beneath the rotor blades. This accentuates the tendency of fibers to roll up into pills.

In an effort to overcome the productivity problem of such systems, complex production systems have been devised utilizing multiple forming heads—for example, up to eight separate spaced forming heads associated with multiple hammermills and each employing two or three side-by-side rotors. The most recent sifting type systems employing on the order of eighteen, twenty or more rotors per forming head, still require up to three separate forming heads in order to operate at satisfactory production speeds—that is, the systems employ up to fifty-four to sixty, or more, separate rotors with all of the attendant complex drive systems, feed arrangements, recycling equipment and hammermill equipment.

During the 1970's a series of patents were issued to C. E. Dunning and his associates which have been assigned to the assignee of the present invention; such patents describing yet another approach to the formation of air-laid dry fiber webs. Such patents include: Dunning U.S. Pat. Nos. 3,692,622, 3,733,234 and 3,764,451; and, Dunning et al. 3,776,807 and 3,825,381. However, this system requires preparation of pre-formed rolls of fibers having high cross-directional uniformity and is not suitable for use with bulk or baled fibrous materials, such that, to date, the system has found only limited commercial application.

Indeed, heretofore it has not been believed that air-forming techniques can be advantageously used in high speed production operations to prepare cellulosic sheet material that is sufficiently thin, and yet has adequate strength, together with softness and absorbency, to serve in applications such as bath tissues, facial tissues and light weight toweling.

SUMMARY OF THE INVENTION

In the present invention there is a method disclosed for forming an air-laid web of dry fibers having a basis weight of from 7.5 to 50 pounds per 2880 square feet. A feed mat of dry fibrous materials is formed which has a controlled cross-directional profile with a coefficient of variation less than 10%. The feed mat is lightly compacted so as to provide sufficient mat integrity to permit its delivery to a forming head, but the compaction of the mat is not great enough to cause hydrogen bonding of the fibers therein.

The dry fibers are dispersed throughout the forming head in a rapidly moving air stream which maintains the fibrous materials free of grinding forces while within the forming head. A portion of the fibrous materials are separated from the aerated bed and discharged from the forming head, these being aggregated fiber masses having a bulk density greater than 0.2 g/cc. The good fibers and soft fiber forces are discharged from the forming head through a discharge opening at a rate of at least 0.5 lbs/hour per square inch of discharge opening. The fibers are conveyed from the forming head to a moving foraminous forming surface through an enclosed forming zone.

The method of the present invention is selected so as to introduce a quantity of dry fibers to a forming head, with the air/fiber suspension being maintained substantially free of cross-flow forces from the time the fiber mat is dispersed until the web is formed on the forming wire. The fiber mat may be dispersed at a position outside the forming head, with the fibers being introduced into the head in an air stream, or the fiber mat may be dispersed within the forming head itself. In either case, the air-laid web produced thereby has a coefficient of variation in the range of 0–5%.

Apparatus for performing the method described above is also described.

DESCRIPTION OF THE DRAWINGS

These and other objects and advantages of the present invention will become more readily apparent upon reading the following detailed description and upon reference to the attached drawings, in which:

FIG. 10 is a graphic representation of throughput capacities of air-laid web forming systems embodying features of the present invention;

FIG. 11 is a graphic representation of the functional relationships existing between nit levels, fiber throughput, and the percentage of fibrous materials separated and/or recycled in the present invention.

Figure 1:
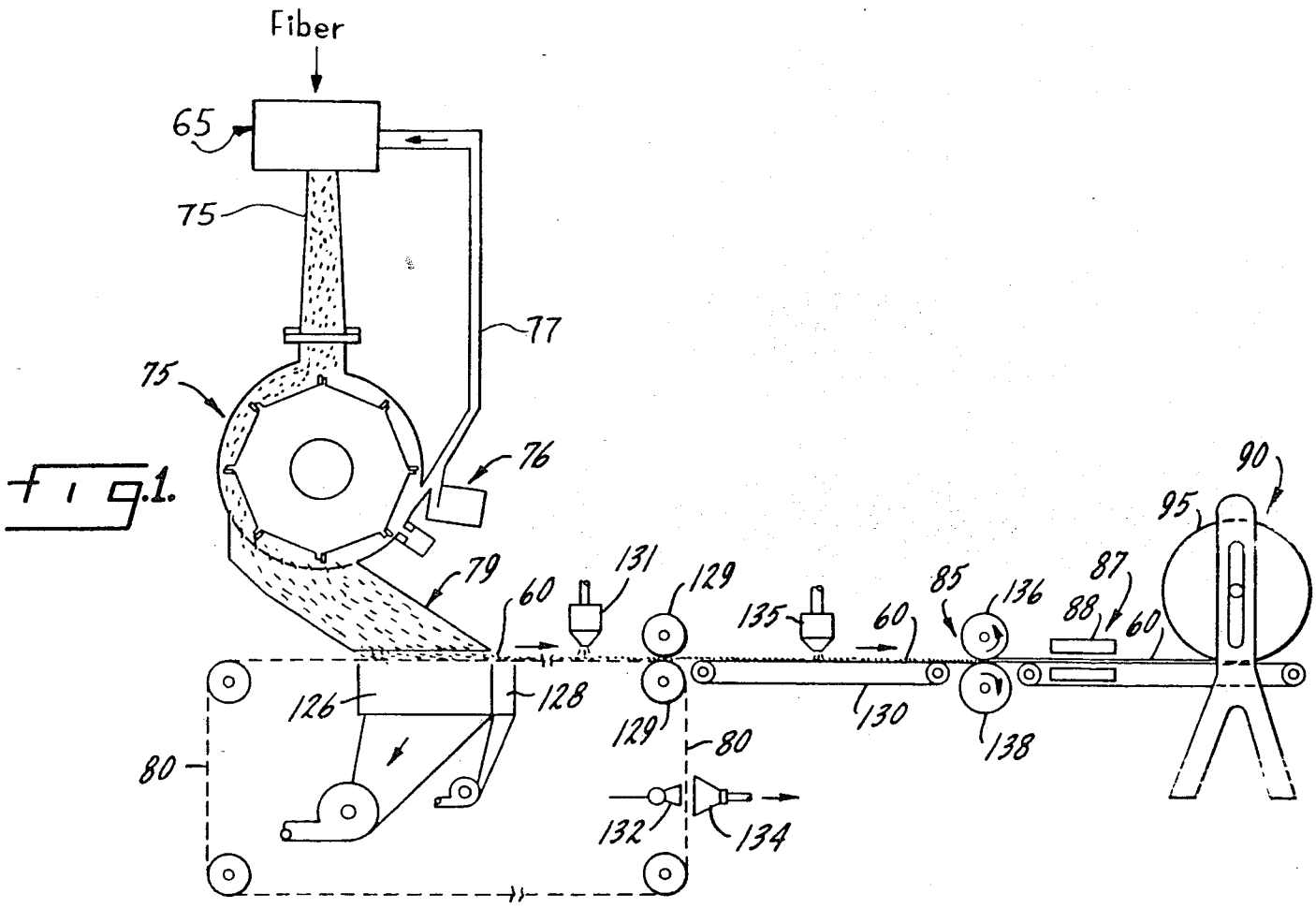
FIG. 1 is a schematic view, in side elevation, of one form of apparatus which has been employed for the air deposition of dry fibers to form a web continuum.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the invention is to cover all modifications, equivalents and alternatives falling within the spirit and scope of the invention as expressed in the appended claims.

DETAILED DESCRIPTION

Referring to FIG. 1, there has been illustrated an exemplary system for forming an air-laid web 60 of dry fibers of the type disclosed and claimed in the application of David W. Appel and Raymond Chung, Ser. No. 106,144, filed Dec. 21, 1979 now abandoned, which is hereby incorporated by reference, such system comprising: a fiber metering section, generally indicated at 65; a fiber transport or eductor section, generally indicated at 70; a forming head, generally indicated at 75, where provision is made for controlling air and fiber flow, and where individual fibers are screened from undesirable aggregated fiber masses and, thereafter, are air-laid on a foraminous forming wire 80; a suitable bonding station, generally indicated at 85, where the web is bonded to provide strength and integrity; a drying station, generally indicated at 87, where the bonded web 60 is dried prior to storage; and, a take-up or reel-type storage station, generally indicated at 90, where the air-laid web 60 of dry fibers is, after bonding and drying, formed into suitable rolls 95 for storage prior to delivery to some subsequent processing operation (not shown) where the web 60 can be formed into specifically desired consumer products.

The forming head 75 includes a separator system, generally indicated at 76, for continuous removal of aggregated fiber masses. Such separated aggregated fiber masses and individualized fibers entrained therewith are preferably removed from the forming area by means of a suitable conduit 77 maintained at a pressure level lower than the pressure within the forming head 75 by means of a suction fan (not shown). The conduit 77 may convey the masses to some other area (not shown) for use in inferior products, for scrap, or, alternatively, the undesirable aggregated fiber masses may be recycled via conduit 78 to a hammermill, generally indicated at 100, where the masses are subjected to secondary mechanical disintegration prior to reintroduction into fiber meter 65. Finally, the forming head 75 also includes a forming chamber, generally indicated at 79, positioned immediately above the foraminous forming wire 80. Thus, the arrangement is such that individual fibers and soft fiber flocs pass through the forming chamber 79 and are deposited or air-laid on the forming wire 80 to form a web 60 characterized by its controlled cross-directional profile and basis weight.

While various types of commercially available fiber metering systems can, with suitable modifications, be employed with equipment embodying the features of the present invention, one system which has been found suitable and which permits of the necessary modifying adaptations is a RANDO-FEEDER® (a registered trademark of the manufacturer, Rando Machine Corporation, Macedon, New York). As here shown, the fiber metering section 65 is mounted on the mezzanine floor level 101 of a suitable paper mill. Fibers may be fed to the fiber separator hopper 102 in any of a variety of conventional ways. For example, pre-opened fibers may be manually introduced in bulk through inlet chute 103 which is provided with a closure member 104 so as to maintain an enclosed chamber. Alternatively, batts or other compacted fibers may be introduced through inlet 105 of hammermill 100 (which is here shown only in diagrammatic block-and-line form and may take any well known conventional form). The compacted batts are fiberized within the hammermill and, after fiberization, the individualized fibers are delivered to the fiber separator hopper 102 via inlet 106. A fan 107 is provided for removing excess air from the fiber separator hopper 102, thereby permitting the fibers to form a loose fiber bed 108 at the bottom of the hopper 102. Thus, the fan 107 functions to withdraw excess air from the hopper 102 and such excess air, together with some escaping fibrous materials, are thereafter discharged into a suitable waste air filter or cyclone separator (not shown). If desired, a conventional pre-feeder and opener-blender (not shown) can be used to feed individualized fibers to the fiber meter 65.

In operation, fibers fall from the fiber separator hopper 102 and form a loose bed 108 of open fibers carried by a floor apron conveyor 109. An anti-static spray system 110 may be provided to minimize adherence of the fibers to portions of the system. The fibers are conveyed by the floor apron conveyor 109 to an elevating apron conveyor 111 having conventional pins and slats (not shown). Fibers are carried upwardly by the elevator apron conveyor to a rotating stripper apron 112 which serves to remove excess fiber stock and return such excess stock to the bed 108. The arrangement is such that a controlled, metered quantity of small opened tufts of fiber remains on the pins of elevator apron conveyor 111 and is carried over the top thereof uniformly across the entire width of apron 111 into an area 113 known as an air bridge.

Fibers delivered to the air bridge 113 are doffed from the pins on apron 111 by means of air flow under the control of a suitable air volume controller 114. As a result of the flow rate of air movement, a controllable quantity of fibers—uniform throughout the full width of air bridge 113—are deposited on a rotating condenser screen 115, thus forming a full-width uniform feed mat 116 conveyed by roller conveyor 118 to a feed plate 119. The arrangement is such that as the feed mat 116 takes shape, the resistance of the mat on condenser screen 115 serves to reduce air flow through the screen and, consequently, proportionally less doffing occurs at apron 111 until a condition of equilibrium is reached. At the equilibrium point, a sufficient quantity of fibers are doffed to form a continuous uniform feed mat 116, with the balance of unused fibers being returned by the pins on elevator conveyor 111 to the fiber bed 108.

It is to be understood that while the fibers most commonly utilized to form webs with the present invention are cellulose fibers, artificial textile-length fibers could be formed into a web for use in many commercial products. As described in the aforesaid application Ser. No. 106,144, the full-width uniform feed mat 116 may then be conveyed over feed plate 119 by means of feed roller 120 and into the path of teeth formed on an opening roll or lickerin 121. The lickerin 121 serves to comb individual fibers from the feed mat 116 with the individualized fibers being picked up and carried by a full-width air stream passing under feed plate 119 and generated by fan 124 and eductor 70. From this point, the entrained stream of individualized air-suspended fibers is introduced into the main air supply stream generated by fan 124 and carried through eductor 60 and the forming head 75, with the fibers exiting the forming head 75 passing through the forming chamber 79 and being uniformly deposited across the full-width of forming wire 80 in a uniform, but completely random, fiber pattern, thereby forming web 60.

In accordance with the present invention, provision is made for forming a lightly compacted feed mat of non-bonded fibers having a controlled cross-directional profile at any desirable remote location and, thereafter, conveying such feed mat in its lightly compacted form directly to the forming head 75, and introducing the feed mat into the forming head where the fibrous materials comprising the mat are instantaneously dispersed in a rapidly moving annular aerated fiber bed 186 by action of the rotor assembly 175 and the high volume air stream generated by fan 124 and introduced to the forming head 175 through inlet slot 171. In carrying out this aspect of the invention, the feed mat initially formed may be formed by any known conventional mat forming system capable of metering fibers to form a mat having a controlled cross-directional profile such, for example, as a conventional multiple scarfing system (not shown) or the fiber metering system 65 shown in FIG. 1.

Figure 3:
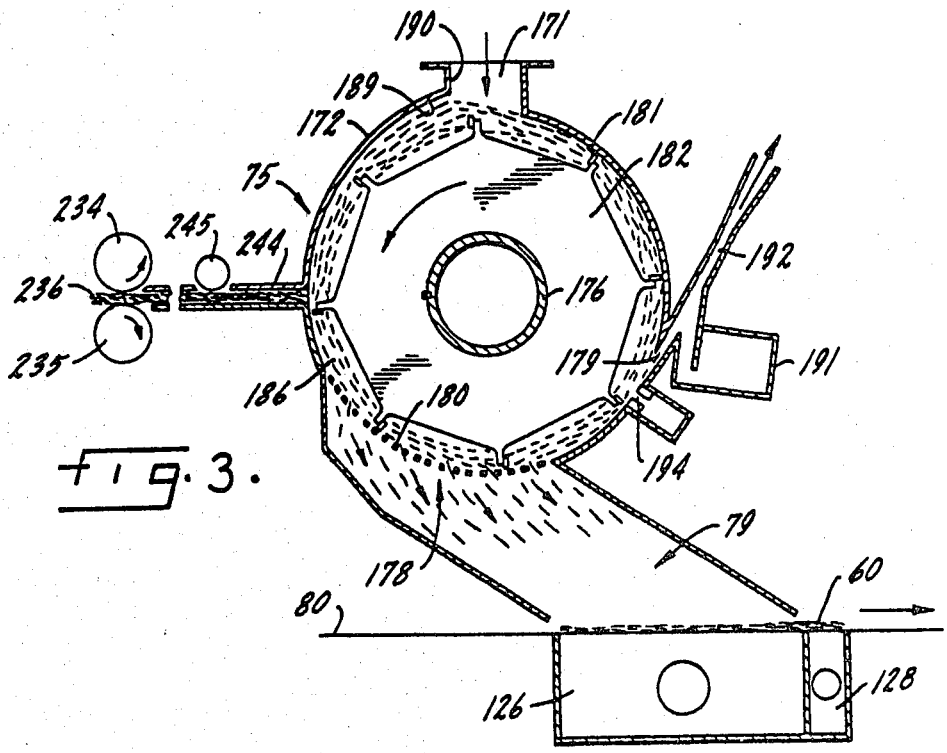
FIG. 3 is a view similar to the rotor chamber portion of FIG. 1, but here depicting an arrangement in which a lightly compacted fed mat of non-bonded fibers is fed directly into the rotor chamber in accordance with the present invention.

Turning to FIG. 3, there has been illustrated one form of system for feeding a lightly compacted feed mat having a controlled C.D. coefficient of variation—e.g., the feed mat 116 formed in the manner shown in FIG. 1—directly into a forming head 75 in accordance with the present invention. As here shown, a feed mat 116 is first conveyed between a pair of full-width compacting rolls 234, 235 which serve to lightly compact the web 116 so as to form a feed mat 236 characterized by its full-width uniformity and having a coefficient of variation of 5% or less. The compacting rolls 234, 235 are hardened steel rolls and are adjusted so as to provide sufficient web compaction to form a feed mat 236 having enough integrity to permit subsequent handling; yet, not sufficient compaction as to cause hydrogen bonding of individual fibers. For example, when working with Northern Softwood Kraft (NSWK) fibers, it has been found that the requisite degree of compaction can be achieved with compacting forces on the order of 200 to 800 p.l.i. (pounds per lineal inch) when using two equal diameter hardened steel rolls 234, 235, each 6" in diameter.

In carrying out this aspect of the present invention, the lightly compacted feed mat 236 of non-bonded fibers thus formed is fed through a remotely located full-width feed inlet 244 radially into rotor housing 172 by means of a feed roll 245. The feed inlet 244 is preferably positioned downstream of air inlet 171 and upstream of discharge opening 178. The arrangement is such that as the feed mat 236 enters housing 172, it radially intersects the aerated bed 186 of fibers which is moving at a relatively high velocity—e.g., on the order of 80 f.p.s.—and, as a result of movement of the high velocity air stream and the rotor bars 181 which are moving at approximately twice the speed of the aerated bed 186 of fibers, the non-bonded, lightly compacted fibers constituting feed mat 236 are instantaneously and uniformly dispersed into the rapidly rotating aerated bed 186 of fibers.

The fibrous materials are, thereafter, selectively passed through screening means 180 disposed in outlet 178 or, alternatively, through full-width tangential separator slot 179, in the manner hereinafter described. Those fibers passing through screening means 180 are conveyed through forming zone 79 and are air-laid on foraminous forming wire 80 to form web 60. It will be noted that in this arrangement, those fibers freshly introduced into the housing 172 through inlet 244 will, at least initially, be principally located within the radially outermost regions of the aerated bed 186 and, consequently, will be in close proximity to the screening means 180; whereas those fibers not discharged through the screen 180 on the first pass will tend to be principally located in the radially innermost regions of the aerated bed 186 of fibers. Consequently, it is believed that this arrangement will permit relatively high forming capacity since a high mass quantum of fibers are dispersed in the outermost regions of the aerated bed just upstream of the screening means 180 where they will have immediate access to the screening means.

Figure 4:
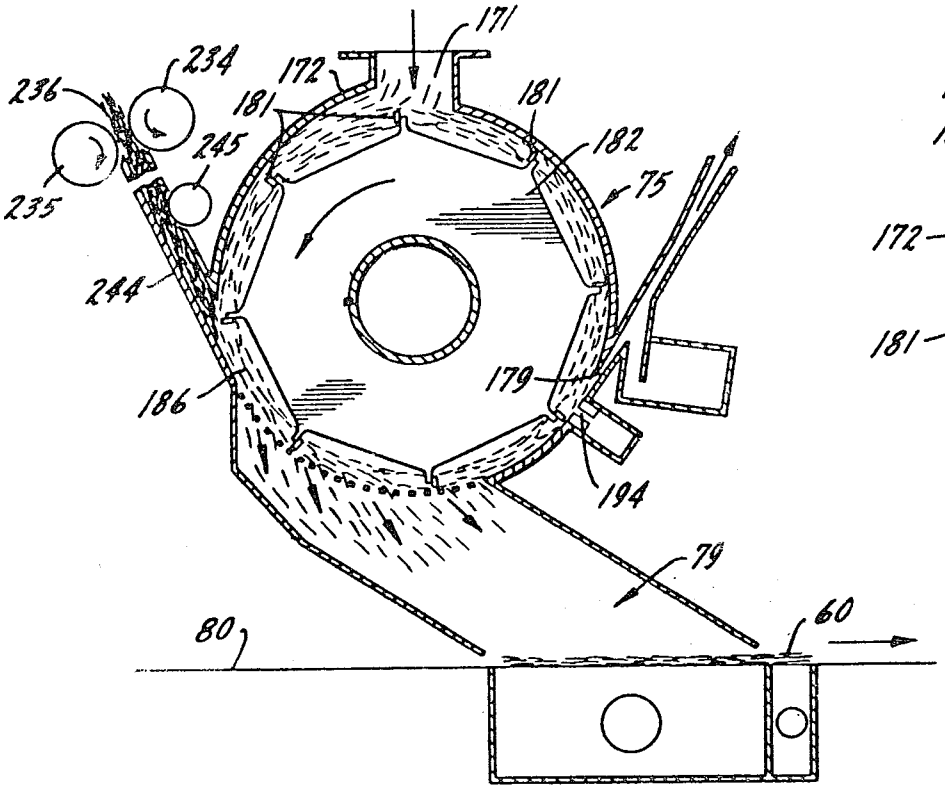
FIG. 4 is a view similar to that of FIG. 3, here illustrating a modified system for feeding lightly compacted mats.

Referring to FIG. 4, there has been illustrated a slightly modified system for introducing a lightly compacted feed mat 236 of non-bonded fibers into a 2-dimensional forming head 75 embodying the features of the present invention. As here shown, the system is essentially identical to that shown in FIG. 3 except that the feed mat 236 is fed into housing 172 tangentially rather than radially, with the mat entering just upstream of screening means 180. Such an arrangement is believed to be highly advantageous to high capacity forming operations since the freshly infed fibers are afforded maximum screen access as they are first entrained in the rotating aerated bed 186 of fibers.

Figure 5:
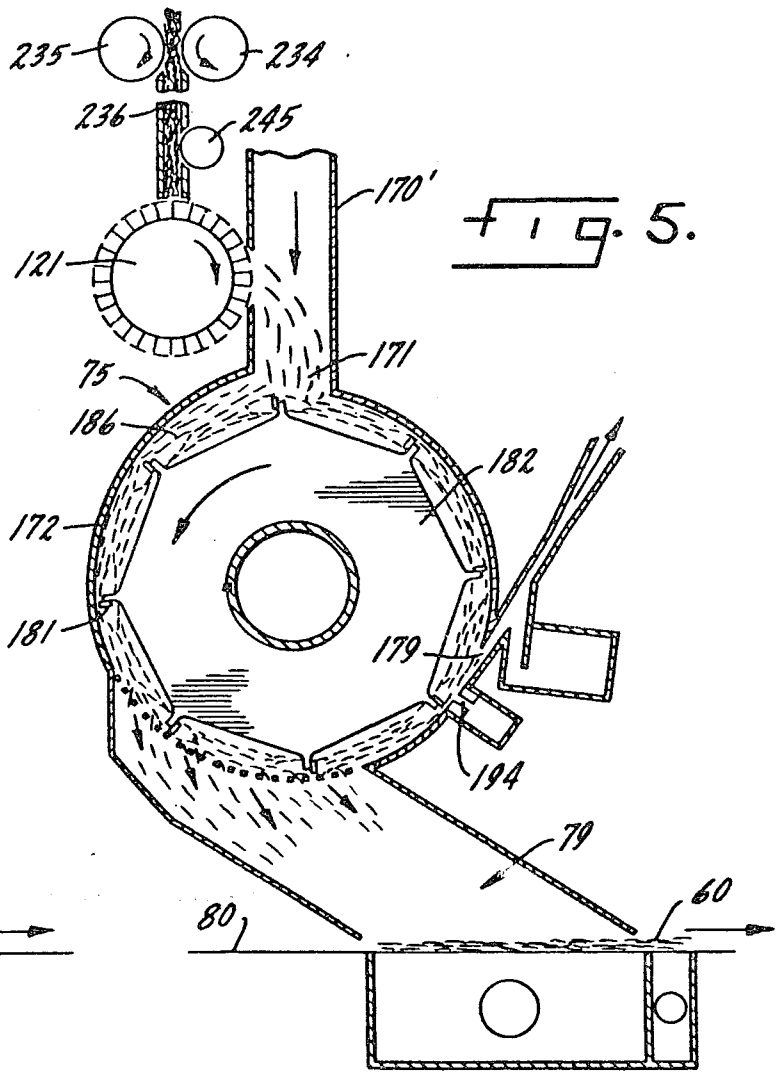
FIG. 5 is a view similar to FIG. 4, but here illustrating a modified system for converting fibers in a lightly compacted feed mat to individualized fibers fed to the rotary flow control and separating chamber in an air-suspended fiber delivery system.

While lightly compacted feed mats 236 of unbonded fibers may be fed directly into the forming head 75 of the present invention in the manner herein described in connection with FIGS. 3 and 4, those skilled in the art will appreciate that the fibers constituting the feed mat 236 can, if desired, by pre-opened and fed into the forming head in an air/fiber stream. Thus, as shown in FIG. 5, the lightly compacted feed mat 236 of non-bonded fibers is fed into the teeth on a full-width opening roll or lickerin 121 located at the lower end of full-width air conduit 170' and just above the inlet 171 to forming head 75. The individualized fibers are combed out of the feed mat 236 and entrained in the high velocity air stream immediately upstream of their entry point into housing 172; thereby eliminating the need for partitioned ducts of the type shown at 174 in FIG. 2 since the fibers are introduced into the 2-dimensional forming head 75 immediately after being combed out of the feed mat.

As a consequence of controlling the cross-directional profile of the feed mat, it is possible to locate multiple forming heads in relatively close, side-by-side proximity, thereby shortening foraminous forming wire runs. At the same time, it is not necessary to provide complex air-suspended fiber delivery systems which require special precautions to preclude generation of cross-flow forces.

In carrying out the invention, the rotor assembly 175 is preferably designed according to the invention disclosed in now abandoned application Ser. No. 106,144.

In carrying out this aspect of the invention, the rotor housing 172 is preferably semi-cylindrical in cross-section throughout at least the arcuate span ranging from the upstream edge 188 of screening means 180 through the tangential separator slot 179, thereby insuring proper clearance between the rotor bars 181 and the inner periphery of both the screening means 180 and housing 172 as the rotor assembly 175 is driven rotationally. The remaining upper segment of the housing 172 may be of any desired shape, including substantially semi-cylindrical, but is preferably relieved immediately adjacent the downstream edge of the inlet slot 171 as indicated at 189, thereby preventing the tendency of those fibers passing the separator slot 179 from impinging against the vertical edge 190 of inlet slot 171 and causing consequent blockage, or partial blockage, of the inlet slot.

Figure 6:
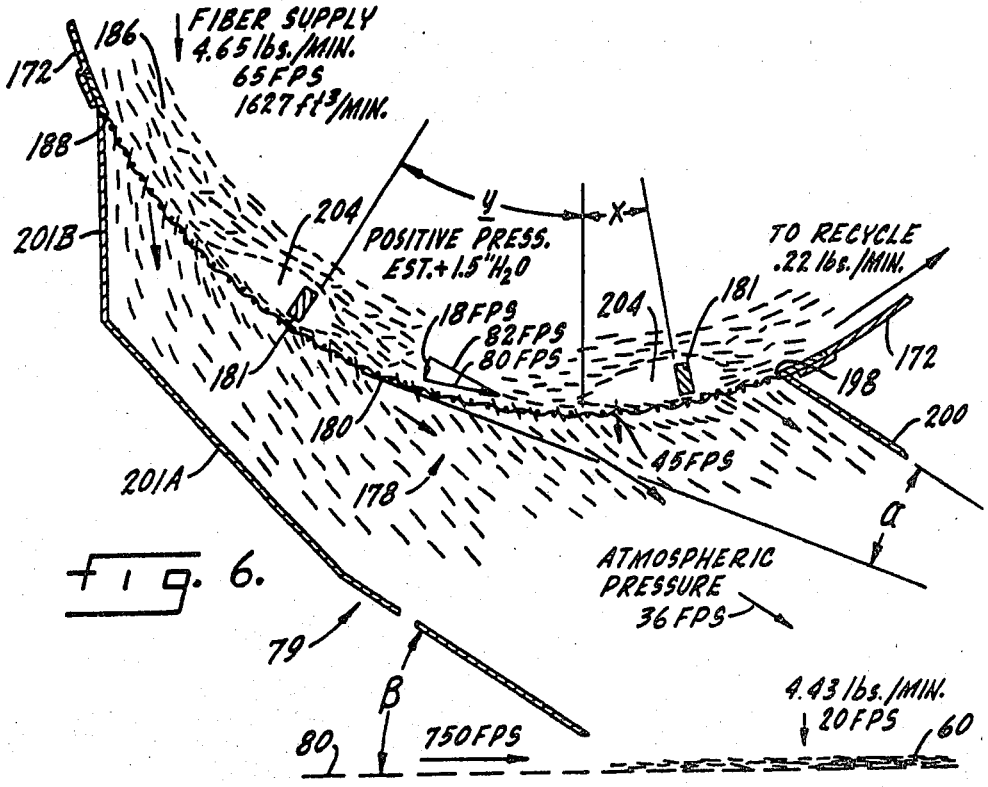
FIG. 6 is an enlarged, fragmentary side elevational view here depicting in diagramatic form the air/fiber stream as it moves through the rotor housing.

Referring again to FIGS. 2, 3, 4 and 5, it will be apparent from the description as thus far set forth, that as fibers are introduced into the rotor housing 172 the fibers are moved rapidly through the housing under the influence of the air stream and movement of the rotor bars 181, thus forming the moving annular aerated bed 186 of fibers (FIG. 6) about the inner periphery of the housing wall. As the aerated bed—which contains individualized fibers, soft fiber flocs, nits and other aggregated fiber masses—passes over the screening means 180, some, but not all, of the individualized fibers and soft fiber flocs pass throught the screening means into the forming zone 79, while the balance of the individualized fibers and soft fiber flocs, together with nits and other aggregated fiber masses, pass over the screen without exiting from the rotor housing 172. The undesired pills, rice and nits (aggretated fiber masses) have a bulk density generally in excess of 0.2 g./cc. and tend to be separated along with some individualized fibers and soft fiber flocs from the aerated bed 186 at the tangential separator slot 179, with those separated materials being centrifugally expelled through the slot 179 where they are entrained in a recycle or separating air stream generated by any suitable means (not shown) coupled to manifold 191 with the air-suspended separated particles moving outward through a full-width discharge passage 192 coupled to separator slot 179 and, ultimately, to conduit 77 (FIG. 1). Such separation is aided by a positive air outflow from housing 172 through separator slot 179.

In keeping with the present invention, provision is made for insuring positive separation of undesired nits and aggregated fiber masses from individualized fibers and soft fiber flocs, and for preventing movement of the latter through separator slot 179 to the full extent possible, thereby insuring that individualized fibers and soft fiber flocs are retained within rotor housing 172 and move with the aerated bed 186 back to the area of screening means 180 where such desirable materials have successive opportunities to pass through the screening means 180 into the forming zone 79. To accomplish this, a full-width classifying air jet 194 is provided upstream of the separator slot 179 and downstream of screening means 180; such air jet being positioned to introduce a full-width air stream generated by any conventional source (not shown) radially into rotor housing 172 just ahead of the separator slot 179. As a consequence, the positive classifying air stream introduced radially into housing 172 through air jet 194 tends to divert individualized fibers and soft fiber flocs within the aerated bed 186 radially inward as a result of the relatively high drag coefficients of such materials and their relatively low bulk density (which is generally on the order of less than 0.2 g./cc.). Since the nits and aggregated fiber masses have a relatively high bulk density in excess of 0.2 g./cc. and relatively low drag coefficients, the classifying air stream introduced through the full-width air jet 194 does not divert such materials to any significant extent and, therefore, such undesired materials tend to be centrifugally expelled through the tangential separator slot 179. It has been found that the introduction of classifying air through the full-width classifying air jet 194 into housing 172 at pressures on the order of from 50" to 100" $H_2O$ and at volumes ranging from 1.5 to 2.5 ft.$^3$/min./in. is adequate for deflecting a significant portion of the individualized fibers and soft fiber flocs. The energy level of the classifying air jet is most conveniently controlled by adjusting its pressure.

In operation, it has been found that excellent results are obtained by limiting the amount of fibrous material removed from the system through separator slot 179 to less than 10% by weight and, preferably, to between 1% and 5% by weight, of the fibrous material introduced into the housing 172 through inlet slot 171. Stated differently, at least 90% of the fibrous materials introduced and, preferably between 95% and 99% thereof, ultimately pass through screening means 180 into the forming zone 79 and are air-laid on the foraminous forming wire 80 without requiring any secondary hammermilling operations and without being subjected to any significant mechanical disintegrating forces. The quantity of material separated may be controlled by the operator by varying the volume of recycle air supplied through manifold 191 and/or by adjusting the circumferential extent of full-width separator slot 179 in any suitable manner (not shown).

Figure 7:
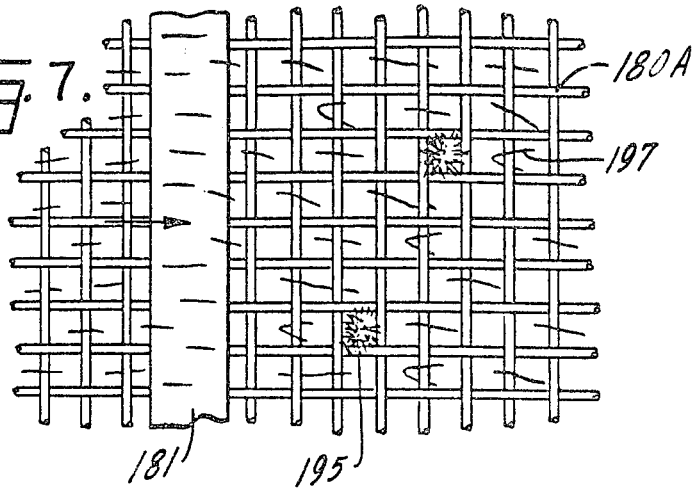
FIG. 7 is a diagramatic plan view indicating in schematic, idealized fashion fiber movement through a conventional woven square-mesh screen under the influence of air movement and rotor action.
Figure 8:
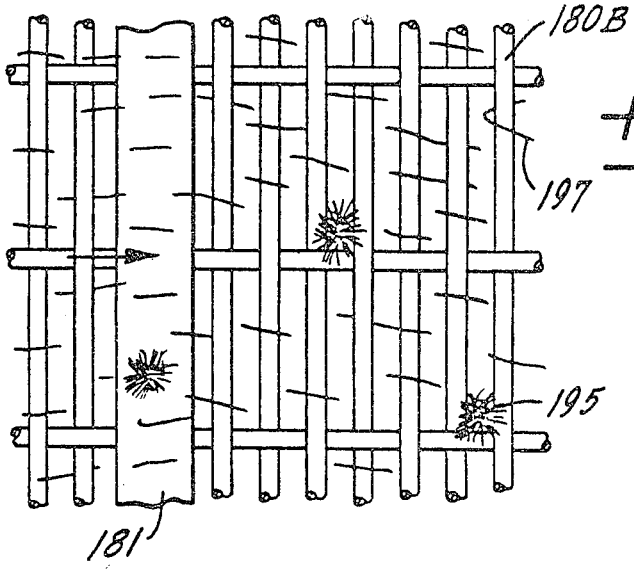
FIG. 8 is a view similar to FIG. 7, but here depicting a high capacity slotted screen with the slots oriented parallel to the axis of the rotor.
Figure 9:
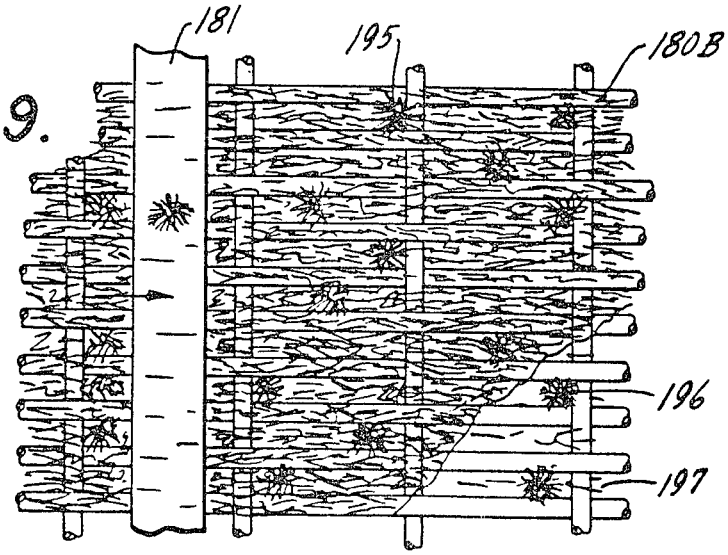
FIG. 9 is a view similar to FIG. 8, but here illustrating a slotted screen with the slots oriented in a direction perpendicular to the axis of the rotor.

Although the present invention has thus far been described in connection with the use of a conventional woven square-mesh screen 180A (FIG. 7) for the screening means 180 shown diagramatically in FIG. 2, it is preferred that the screening means 180 take the form of a high capacity slotted screen 180B of the type shown in FIG. 8 and as described and claimed in the aforesaid co-pending application Ser. No. 106,142. When utilizing a slotted type screen 180B with a 2-dimensional rotor assembly 175 mounted for rotation about a horizontal axis, it has been found essential that the screen slots be oriented with their long dimensions parallel to the axis of the rotor assembly. When so oriented, individualized fibers tend to move through the screen slots while nits and aggregated fiber masses are precluded from passing through the screen since they are generally larger in size then the narrow dimensions of the slots which, preferably, do not exceed 0.1" open space from wire-to-wire in at least one direction. However, when the slots of a slotted screen 180B are oriented with their long dimensions perpendicular to a plane passing through the rotor axis as shown in FIG. 9, it has been found that the screen tends to rapidly plug—indeed, when operating under commercial production conditions, it has been found that the screen tends to become completely plugged almost instantaneously.

Figure 2:
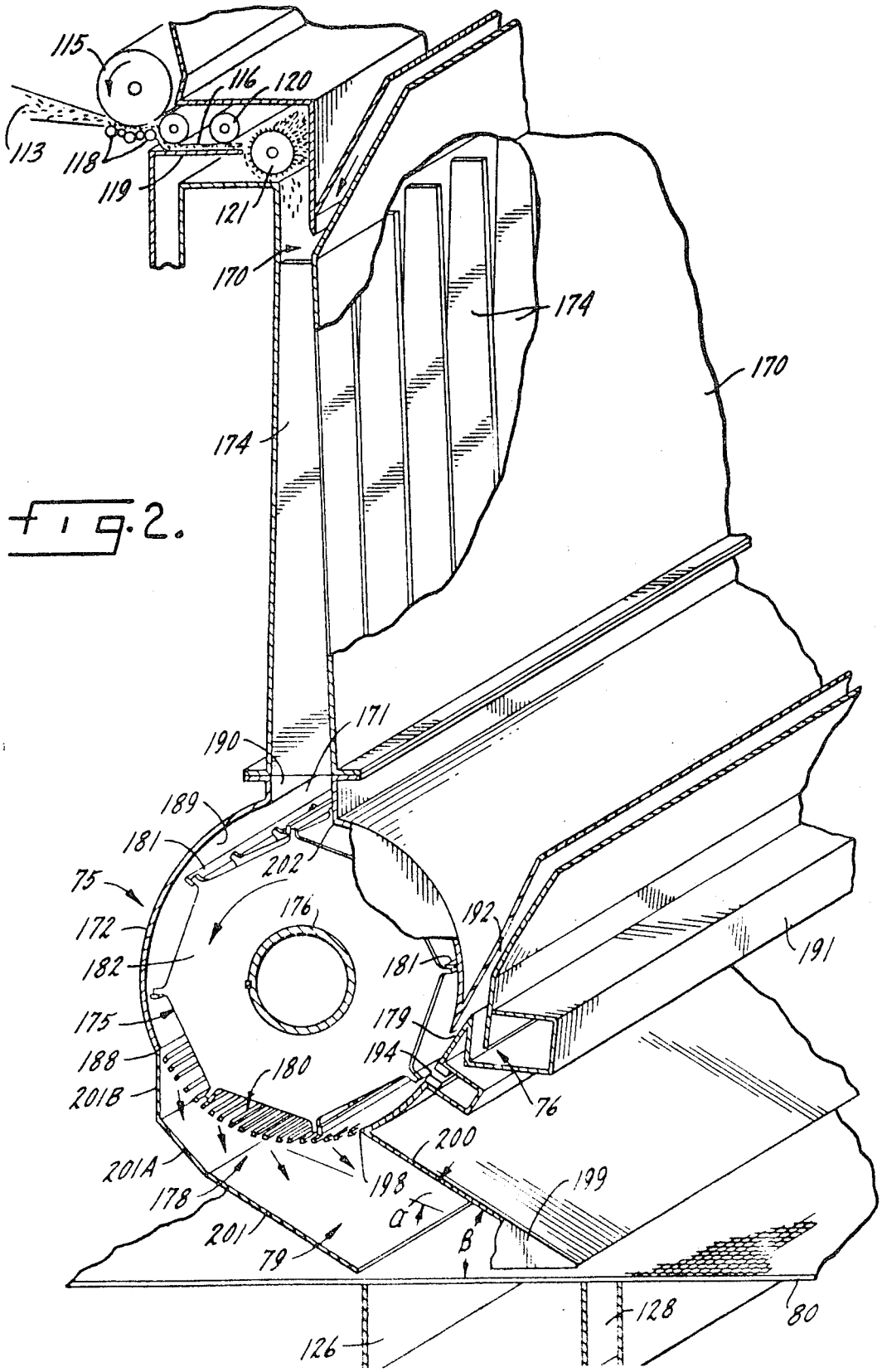
FIG. 2 is a partial oblique view schematically illustrating details of the apparatus of FIG. 1.

The exemplary system herein described has been depicted in FIG. 2 as including a rotor assembly 175 having eight rotor bars 181. However, the number and/or shape of the rotor bars may be varied, provided that such modifications are consistent with mechanical stability and low rotor "pumping" action. That is, the rotor assembly 175 must be a dynamically balanced assembly and, therefore, it must include at least two rotor bars. Care must be taken to insure that the number of rotor bars employed and the shape of the rotor bars are such that pumping action is minimized. Otherwise, the rotor assembly 175 will tend to sweep the aerated fiber bed 186 over and beyond the screening means 180 rather than permitting and, indeed, assisting fiber movement through the screening means.

In the illustrative form of the invention, the rotor bars 181 have a rectangular cross-section, and pumping action is minimized by keeping the effective rotor bar area relatively small ($\frac{3}{4}$" times the length of the bars which extend across the full width of the rotor housing 172) and by spacing the bars apart circumferentially by 45° (there being eight equally spaced bars) and from the housing 172 by on the order of 0.18" to 0.20". However, the rotor bars 181 need not be rectangular in cross-section. Rather, they can be circular, vane-shaped, or virtually any other desired cross-sectional configuration not inconsistent with the objective of minimizing rotor pumping action. However, the primary function of the rotor assembly is to lift fibers off the screen so as to permit passage of the air-suspended fiber stream therethrough. This desirable result is achieved by the negative pressure zones created in the wakes of the moving rotor bars; and, the negative pressure zones in the wakes of rotor bars having a rectangular cross-section have been found to be as effective for this purpose as those created by rotor bars of circular cross-section.

It is significant to a complete understanding of the present invention that one understand the difference between the primary function of the rotor assembly here provided—to lift fibrous materials upwardly and off the screen or, stated differently, to momentarily disrupt passage of the air-suspended fiber stream through the screen—and that stated for conventional cylindrical rotor systems of the type disclosed in the aforesaid J.D'A. Clark patents where the rotor chamber functions as a "disintegrating and dispersing chamber" (See, col. 4, line 53, J.D'A. Clark U.S. Pat. No. 2,931,076), where the rotor blades mechanically act upon the fibrous materials to "disintegrate" such materials and propel them through the screen.

In keeping with the present invention, provision is made for insuring that individualized fibers passing through the screening means 180 shown in FIG. 2 are permitted to move directly to the foraminous forming wire 80 without being subjected to cross-flow forces, eddy currents or the like, thereby maintaining cross-directional control of the mass quantum of fibers delivered to the forming wire through the full-width of forming zone 79. To accomplish this, provision is made for insuring that the upstream, downstream and side edges of the forming zone are formed so as to define an enclosed forming zone and to thereby preclude intermixing of ambient air with the air/fiber stream exiting housing 172 through screening means 180. The forming zone is described with more particularity in now abandoned application Ser. No. 106,144. The forming zone is preferably dimensioned so that under normal adjustment of variable system operating parameters, the velocity of the fiber/air stream through the forming zone is at least 20 f.p.s. and the fibers are capable of traversing the entire length of the forming zone 79 from screen 180 to forming wire 80 in not more than 0.1 second.

Numerous system parameters may be varied in the operation of a forming system embodying the features of the present invention in order to form an air-laid web of dry fibers having a basis weight of from 7.5 lbs/2880 ft.$^2$ (tissue) to at least 50 lbs/2880 ft.$^2$ (towels). (It is to be understood that while the present invention finds its primary use in the production of relatively light weight disposable products, it could be used to produce much higher basis weight products, such as disposable diapers, with a basis weight approaching 100 lbs/2880 ft.$^2$). Such variable parameters include, for example: air-to-fiber ratio in aerated fiber bed 186 (which is, preferably 200–600 ft.$^3$/lb. when working with cellulosic wood fibers, and preferably 1000 to 3000 ft.$^3$/lb., and perhaps higher, when working with cotton linters and relatively long synthetic fibers); air pressure within housing 172 (which preferably varies from +0.5" to +3.0" $H_2O$); rotor speed (which preferably varies from 800 to 1800 RPM); the number, orientation and shape of rotor bars employed; the quantity of air supplied per foot of former width (which is, preferably, on the order of 1500 to 1650 ft.$^3$/min. with an 8-bar rotor operating at 1432 RPM); the energy level of classifying air supplied (which preferably ranges from 1.5 to 2.5 ft.$^3$/min./in. or, stated in terms of pressure, preferably ranges from 50" to 100" $H_2O$); recycle or separation balance (which is less than 10% by weight of the fiber supplied and, preferably, from 1% to 5% by weight of the fiber supplied); screen design—whether the screen is a woven square-mesh screen or a slotted screen, the size of the screen openings (which range between 0.02" and 0.1" wire-to-wire open space in at least one direction and, preferably, range between 0.045" and 0.085" wire-to-wire open space in at least one direction), the wire diameter used (which preferably varies from on the order of 0.023" to 0.064") and, the percentage of open screen area (which is between 30% and 55% and, preferably, varies from 38% to 46%); air pressure within the enclosed forming zone 79 (which is preferably atmospheric); as well as the physical dimensions of the forming head 75 (which, in the exemplary form of the invention, comprises a generally cylindrical housing 172 having an inside diameter of 24").

Moreover, the rate of production of the web being formed can also be varied by altering numerous other system parameters such as the number of forming heads 75 used, the position of the forming head relative to the forming wire—i.e., whether the forming head is mounted in the cross-direction, the machine-direction, or at some angle therebetween—forming wire speed, and the type of fibers used. Still other variable parameters under the control of the operator include the cross-directional profile of the feed mat delivered to the forming head 75. Thus, where it is desired to produce a web having a uniform cross-sectional profile with an acceptable coefficient of variation, the lightly compacted feed mat 236 in FIGS. 3, 4 and 5, preferably will have a uniform cross-directional profile in terms of the mass quantum of fibers present. On the other hand, if one desires to produce an air-laid web having a specific non-uniform cross-sectional profile e.g., an absorbent filler web having a central portion with a relatively high basis weight and marginal edges of relatively low basis weights—it is merely necessary to form either a single lightly compacted feed mat or multiple side-by-side lightly compacted feed mats having the requisite cross-directional profile and, since the present system is substantially devoid of cross-directional forces, the cross-directional profile of the input feed mat(s) will control the cross-directional profile of the air-laid web.

As previously indicated the rotor assembly 175 may be formed with n rotor bars 181 where n equals any whole integer greater than "1". However, it has been ascertained that fiber throughput—a limiting constraint when attempting to maximize productivity—is a function of rotor speed multiplied by the square root of the number of rotor bars employed—i.e., fiber throughput: $\int(\text{RPM}\times\sqrt{\text{No. of rotor bars } \mathbf{181}})$. This relationship will, of course, vary with the particular screen employed; and, has been graphically illustrated in FIG. 10 wherein fiber throughput in lbs./in./hr. (the ordinate) has been plotted at various rotor speeds for each of a 2-bar, 4-bar, and 8-bar rotor assembly (the abscissa) when using both a coarse wire screen (10×2.75; 0.047" wire dia.; 0.059" screen opening; and 46.4% open screen area) and a fine wire screen (16×4; 0.035" wire dia.; 0.032" screen opening; and 38.8% open screen area). As here shown, the circular points 205 are each representative of fiber throughput at a given rotor speed multiplied by the square foot of "2" and are, therefore, indicative of throughput for a 2-bar rotor. Similarly, the triangular points 206 are each indicative of fiber throughput for a 4-bar rotor, while the square points 208 are indicative of fiber throughput for an 8-bar rotor.

Thus, the line 209 (FIG. 10) represents the Regressor, or "line-of-best-fit", from which functional relationships between throughput and rotor speed can be determined when using a coarse wire screen of the type described above. Similarly, the line 210 represents the same functional relationships when using a fine wire screen of the type described above. The data thus corroborates experimental findings that rotor RPM can be reduced while fiber throughput is maintained, or even increased, by going from a 4-bar rotor assembly to an 8-bar rotor assembly. However, when using an 8-bar rotor assembly 175, the forming system seems to be less tolerant of mismatches between forming air and rotor speed; and, where such mismatches occur, fibers tend to accumulate on the sidewalls 199 of the forming zone 79. This is readily corrected by reducing rotor speed, normally by less than 10%, while maintaining forming air constant.

It has further been discovered that both nit levels in the air-laid web 60, and fiber throughput in lbs./hr./in.$^2$, are a function of the percentage of fibrous materials removed from the aerated bed 186 (FIG. 6) through the full-width separator slot 179 (FIG. 2). Thus, referring to FIG. 11, line 211 graphically portrays the decreasing relationship of nit level (the ordinate) with increasing separation/recycle percentages (the abscissa); while, at the same time, increasing separation/recycle percentages are accompanied by increased fiber throughput in lbs./hr./in.$^2$. The graph is here representative of a system in which the rotor assembly 175'—a 4-bar rotor assembly—was driven at 1700 RPM and fibers were introduced into the rotor housing 172 (FIGS. 2 and 5) in an air stream supplying air at approximately 106 ft.$^3$/min./in. When the percentage of fibrous material separated through separator slot 179 was 1%, fiber throughput was 0.62 lbs./hr./in.$^2$, and the air-laid web 60 exhibited a nit level of "3"—a level deemed to be "poor", or border-line between acceptable and non-acceptable. As hereinafter described in more detail, numerical nit levels range from "0" ("excellent"), to "1" ("good"), to "2" ("adequate"), to "3" ("poor"), to "4" through "6" ("inadequate" to "non-acceptable"). Such numerical ratings are subjective ratings based upon visual inspection of the formed web 60 and subjective comparison thereof with pre-established standards.

As the pressure of the recycle air supplied through manifold 191 (FIG. 2) is decreased and/or as separator slot 179 is widened, thereby modulating the pressure conditions within discharge conduits 192 (FIG. 2) and 77 (FIG. 1) which are maintained at a pressure level below that within the forming head 75 by means of a suction fan (not shown), the amount of fibrous material removed from rotor housing 172 through separator slot 179 is increased. Other means such as venturi passageways (not shown) could also be used to insure a controlled outflow of materials through separator slot 179.

As the percentage of fibrous materials separated and/or recycled increases, nit level in the formed web 60 decreases. At the operating conditions under which FIG. 11 was prepared, when the separation percentage was increased to approximately 2.5%, a web having a nit level of "2" (i.e., an "adequate" nit level rating) was produced; at a separation percentage of 3%, the web's nit level decreased to approximately "1.6" (i.e., approximately midway between "adequate" and "good"); at a separation percentage of approximately 3.8%, nit level dropped to "1" ("good"); and, at a separation percentage of 5%, nit level dropped to approximately "0" ("excellent").

FIG. 11 also shows that the throughput of the forming system was increased from 0.62 lbs./hr./in.$^2$ to 0.96 lbs./hr./in.$^2$ while at the same time improving web quality from "poor" to "excellent". The total amount of fiber delivered to the forming system was increased by an even greater percentage to compensate for the increased removal of fiber and aggregate for recyclying. Productivity of the forming system was thus increased about 55% even though the screen was more heavily loaded with fiber; a very significant improvement. These comparisons were made while running good quality pulp (Northern Softwood Kraft) having a low content of pulp lumps and being well fiberized in the hammermill. Poorer quality pulps or less effective fiberization would require higher recycle rates of up to 10% to maintain an acceptable nit level in the web being formed. When making less critical webs or thick batts, nit level and recycle rate become less critical.

Those skilled in the art will, of course, appreciate that the experimental data set forth in FIG. 11 is only representative for one given set of operating parameters; and, such data will vary with changes in, e.g., air-to-fiber ratio, type of fiber used, rotor speed, rotor design, air supply, and/or screen characteristics. However, experiments have indicated that recycle percentage is critical and, for cellulosic fibers, should exceed 1%, is preferably between about 1% and 5%, and should be less than on the order of 10%.

It will be appreciated by those skilled in the art that the present invention is uniquely suited for forming high quality webs having virtually any desired basis weight in lbs./2880 ft.$^2$ at relatively high forming wire speeds. Indeed, such extremely high productivity rates may be readily set forth as follows: A web having a basis weight of (x) (17 lbs./2880 ft.$^2$) where "x" is equal to any desired whole or fractional value, can be produced at a forming wire 80 speed of 750 f.p.m. divided by "x"; or, $$(x)\ (17\ \text{lbs./2880 ft.}^2) = \text{forming wire speed}\ \frac{(750\ f.p.m.)}{x}$$

Similarly, where N forming heads are used the foregoing relationship of web basis weight to forming wire 80 speed may be expressed as follows:

$$(x)\ (17\ \text{lbs./2880 ft.}^2) = \text{forming wire speed}\ \frac{(N)\ (750\ f.p.m.)}{x}$$

Based on the experimental data reported herein and in copending application Ser. No. 106,144, it is evident that dramatic improvements in fiber throughput capacity for the forming head can be obtained irrespective of whether fibrous materials are delivered to the forming head in bulk air-suspended form or, as with the present invention, in the form of a lightly compacted feed mat. Thus, fiber throughputs ranging from approximately 0.5 lbs./hr./in.$^2$ to in excess of 1.50 lbs./hr./in.$^2$ have been obtained when working with cellulosic wood fibers and a former 75 24" in diameter. Moreover, it should be noted that the foregoing range of from 0.5 lbs./hr./in.$^2$ to at least 1.50 lbs./hr./in.$^2$ reflects efforts made to form high quality, lightweight tissue and/or towel grade products. Where product quality in terms of nit level can be accepted at lower quality levels, it can be expected that fiber throughput will exceed, and may substantially exceed, the level of 1.50 lbs./hr./in.$^2$. Similarly, when actual production experience has been acquired, it can be expected that fiber throughputs will be regularly achieved which do exceed the level of 1.50 lbs./hr./in.$^2$, and such improved results may also be achieved when the system is scaled up in size with rotor assemblies on the order of 36" in diameter.

Those skilled the the art will appreciate that there has herein been described a novel web forming system characterized by its simplicity and lack of complex, space-consuming, fiber handling equipment; yet, which is effective in forming air-laid webs of dry fibers at commercially acceptable production speeds irrespective of the basis weight of the web being formed. At the same time, the absence of cross-flow forces insures that the finished web possesses the desired controlled C.D. profile which may be either uniform or non-uniform.

I claim:

1. A method of forming an air-laid web of dry fibers having a basis weight of from 7.5 to 50 lbs./2880 ft.$^2$ comprising:

(a) forming a feed mat of dry fibrous materials having a controlled cross-directional profile;

(b) compacting the feed mat to provide sufficient mat integrity to permit delivery to a remote point yet without sufficient compaction as to cause hydrogen bonding of fibers;

(c) delivering the compacted feed mat to a forming head positioned over a moving foraminous forming surface;

(d) dispersing the dry fibrous materials uniformly throughout the forming head in a rapidly moving aerated bed of individualized fibers, soft fiber flocs and aggregated fiber masses and in an environment maintained substantially free of fiber grinding and disintegrating forces;

(e) continuously separating from the aerated bed a portion of the dry fibrous materials in the form of aggregated fiber masses having a bulk density in excess of 0.2 g./cc;

(f) discharging said aggregated fiber masses from the forming head;

(g) conveying the individualized fibers and soft fiber flocs from the forming head through a discharge opening at a fiber throughput rate of at least 0.5 lbs./hr. per square inch of discharge opening through an enclosed forming zone;

(h) air-laying the individualized fibers and soft fiber flocs on the moving foraminous forming surface so as to form an air-laid web of randomly oriented dry individualized fibers and soft fiber flocs on the forming surface.

2. The method as set forth in claim 1 wherein the individualized fibers and soft fiber flocs are conveyed from the forming head at a rate of approximately 1.23 lbs./hr. per square inch of screen surface, and the relationship of the basis weight to the forming surface speed is in accordance with the following set of operating parameters: basis weight=(x) (17 lbs./2880 ft.$^2$) at a forming surface speed of about 750 f.p.m./x (where x equals any whole or fractional number).

3. The method as set forth in claim 1 wherein from 1% to 10% of the fibrous materials in the compacted mat are separated from the aerated bed and discharged from the forming head, and the air-laid web formed has a nit level of from "0" to "3".

4. The method as set forth in claim 1 wherein steps (d), (e), (g) and (h) are carried out in an environment essentially devoid of cross-flow forces so as to maintain cross-directional control of the mass quantum of fibers being processed and of the cross-directional profile of the air-laid web produced.

5. The method as set forth in claim 2 wherein steps (d), (e), (g) and (h) are carried out in an environment essentially devoid of cross-flow forces so as to maintain cross-directional control of the mass quantum of fibers being processed and of the cross-directional profile of the air-laid web produced.

6. The method as set forth in claim 4 wherein the mass quantum dispersion of fibrous materials in the compacted feed mat delivered to the forming head in step (c) is essentially uniform in cross-directional profile and the air-laid web produced has a cross-directional coefficient of variation in the range of zero to 5%.

7. The method as set forth in claim 5 wherein the mass quantum dispersion of fibrous materials in the compacted feed mat delivered to the forming head in step (c) is essentially uniform in cross-directional profile and the air-laid web produced has a cross-directional coefficient of variation in the range of zero to 5%.

8. The method as set forth in claim 5 wherein the fibrous materials in the compacted feed mat delivered in step (c) are pre-opened adjacent the forming head and are delivered into the forming head suspended in an air stream.

9. The method as set forth in claim 5 wherein the fibrous materials in the compacted feed mat delivered in step (c) are dispersed from the feed mat within the forming head.

10. The method as set forth in claim 1 wherein said forming head is provided with a plurality of rotor blades rotating about a horizontal axis within said forming head, said rotor blades conveying the dry fibrous materials through the forming head in said aerated bed.

11. The method as set forth in claim 10 wherein a positive pressure of from 0.5" to 3.0" $H_2O$ is maintained within the forming head so as to cause a pressure drop across the discharge opening of approximately 0.5" to 3.0" $H_2O$.

12. The method of forming a quality web of air-laid dry fibers on a high speed production basis comprising the steps of:

(a) forming a feed mat of fibers having a controlled cross-directional profile;

(b) lightly compacting the feed mat to provide sufficient mat integrity to permit delivery to a remote point yet without sufficient compaction as to cause hydrogen bonding of the fibers;

(c) delivering the lightly compacted feed mat to a forming head positioned over a forming surface;

(d) dispersing the dry fibrous materials comprising the feed mat uniformly thoughout forming head in a rapidly moving aerated bed of individualized fibers, soft fiber flocs and aggregated fiber masses and in an environment maintained substantially free of fiber grinding and disintegrating forces;

(e) continuously separating a substantial portion of those fibrous materials delivered to the forming head having a bulk density in excess of 0.2 g./cc. from the aerated bed so as to separate a substantial portion of the aggregated fiber masses from the aerated bed;

(f) discharging such separated fibrous materials including the aggregated fiber masses contained therein from the forming head;

(g) conveying the individualized fibers and soft fiber flocs from the forming head at a fiber throughput rate anywhere in the range of 0.5 lbs./hr./in.$^2$ to at least 1.50 lbs./hr./in.$^2$ through an enclosed forming zone towards the moving foraminous forming surface in a rapidly moving air stream;

(h) air-laying the individualized fibers and soft fiber flocs on the moving foraminous forming surface so as to form an air-laid web of randomly oriented dry individualized fibers and soft fiber flocs on the forming surface; and, (i) moving the foraminous forming surface at a controlled and selected speed so as to produce an air-laid web having any specific desired basis weight in, lbs./2880 ft.$^2$ ranging from at least as low as 13 lbs./2880 ft.$^2$ to in excess of 40 lbs./28880 ft.$^2$.

* * * * *